US008843017B2

(12) United States Patent
Asaka

(10) Patent No.: US 8,843,017 B2
(45) Date of Patent: Sep. 23, 2014

(54) IMAGE FORMING APPARATUS INCLUDING DEHUMIDIFICATION HEATER AND CONTROL METHOD FOR IMAGE FORMING APPARATUS INCLUDING DEHUMIDIFICATION HEATER

(75) Inventor: Hitoshi Asaka, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 366 days.

(21) Appl. No.: 13/305,770

(22) Filed: Nov. 29, 2011

(65) Prior Publication Data

US 2012/0134708 A1 May 31, 2012

(30) Foreign Application Priority Data

Nov. 30, 2010 (JP) ..... 2010-266914

(51) Int. Cl.
*G03G 21/20* (2006.01)

(52) U.S. Cl.
CPC .... *G06G 21/203* (2013.01); *G03G 2215/00776* (2013.01)
USPC ..... 399/97

(58) Field of Classification Search
CPC ..... G03G 21/203; G03G 2215/00776
USPC ..... 399/97, 390
See application file for complete search history.

(56) References Cited

U.S. PATENT DOCUMENTS

2008/0003000 A1 * 1/2008 Taki et al.
2008/0247774 A1 * 10/2008 Koga ..... 399/97

FOREIGN PATENT DOCUMENTS

JP 7-319369 12/1995
JP 2008233262 A * 10/2008

* cited by examiner

*Primary Examiner* — Walter L Lindsay, Jr.
*Assistant Examiner* — Milton Gonzalez
(74) *Attorney, Agent, or Firm* — Smith, Gambrell & Russell LLP

(57) ABSTRACT

An image forming apparatus includes, a sheet feeding unit including a dehumidification heater, a humidity sensing element for sensing humidity, a dehumidification heater switching unit, a control unit for bringing the dehumidification heater switching unit into an ON state when a recognized humidity is equal to or greater than a predetermined reference value and bringing the dehumidification heater switching unit into an OFF state when the recognized humidity fails below the predetermined reference value, and a power supply unit for temporarily resuming the supply of power to the control unit in a power saving mode, in a longer cycle, after the supply of power to the control unit was stopped based on a predetermined large difference between the humidity recognized by the control unit and the predetermined reference value.

10 Claims, 8 Drawing Sheets

| HUMIDITY | CYCLE |
|---|---|
| Ht1 ≦ H | SECOND CYCLE |
| Ht ≦ H < Ht1 | FIRST CYCLE |
| Ht2 ≦ H < Ht | FIRST CYCLE |
| H < Ht2 | SECOND CYCLE |

※ NOTE THAT, FIRST CYCLE < SECOND CYCLE

| HUMIDITY | CYCLE |
|---|---|
| Ht1 ≦ H | SECOND CYCLE |
| Ht ≦ H < Ht1 | FIRST CYCLE |
| H < Ht | SECOND CYCLE |

※ NOTE THAT, FIRST CYCLE < SECOND CYCLE

FIG. 11

| TEMPERATURE RANGE | VALUE | |
|---|---|---|
| 30°C < t ≦35°C | REFERENCE VALUE | $Ht_{01}$ |
| | FIRST THRESHOLD VALUE | $Ht_{11}$ |
| | SECOND THRESHOLD VALUE | $Ht_{21}$ |
| | FIRST CYCLE | $T_{11}$ |
| | SECOND CYCLE | $T_{21}$ |
| 25°C < t ≦30°C | REFERENCE VALUE | $Ht_{02}$ |
| | FIRST THRESHOLD VALUE | $Ht_{12}$ |
| | SECOND THRESHOLD VALUE | $Ht_{22}$ |
| | FIRST CYCLE | $T_{12}$ |
| | SECOND CYCLE | $T_{22}$ |
| ⋮ | ⋮ | ⋮ |
| 0°C < t ≦5°C | REFERENCE VALUE | $Ht_{03}$ |
| | FIRST THRESHOLD VALUE | $Ht_{13}$ |
| | SECOND THRESHOLD VALUE | $Ht_{23}$ |
| | FIRST CYCLE | $T_{13}$ |
| | SECOND CYCLE | $T_{23}$ |

IMAGE FORMING APPARATUS INCLUDING DEHUMIDIFICATION HEATER AND CONTROL METHOD FOR IMAGE FORMING APPARATUS INCLUDING DEHUMIDIFICATION HEATER

This application is based upon and claims the benefit of priority from the corresponding Japanese Patent Application No. 2010-266914 filed on Nov. 30, 2010, the entire contents of which are incorporated herein by reference.

BACKGROUND OF THE DISCLOSURE

1. Field of the Disclosure

The present disclosure relates to an image forming apparatus, such as a printer, a copier, a multifunction peripheral, and a fax machine, including a dehumidification heater for heating housed sheets, and to a control method therefor.

2. Description of Related Art

Some image forming apparatuses house therein a plurality of sheets. When the sheets absorb moisture, it is sometimes the case that creases or jam (being stuck) is likely to occur at the time of conveyance and fixation. In addition, for example, when moisture (water vapor) enters in between sheets, the sheets may adhere to one another, causing multiple sheet feeding of sheets (conveyance of sheets stacked one on top of another). Accordingly, a dehumidification heater may be provided inside an image forming apparatus in order to remove moisture.

For example, the following sheet feeding apparatus is known. Specifically, the known sheet feeding apparatus includes, inside a main body housing thereof that houses a large number of print sheets: a feeding mechanism for sequentially feeding the print sheets; a dehumidification heater disposed inside the main body housing; internal temperature measuring means for measuring an internal temperature of the main body housing; external temperature measuring means for measuring an external temperature of the main body housing; and dehumidification heater control means for controlling the drive of the dehumidification heater based on the temperatures respectively measured by the external temperature measuring means and the internal temperature measuring means. This configuration is designed to prevent a decrease in life of a photosensitive member due to a significant temperature increase inside the main body housing caused by the dehumidification heater being driven continuously, and an unnecessary increase in power consumption caused by driving the dehumidification heater even in a situation where no dehumidification is required.

First, on the image forming apparatus, a control unit (controller) for controlling the energization of the dehumidification heater in the sheet feeding unit is mounted. For example, the control unit recognizes the humidity based on an output of a humidity sensor. Then, the control unit energizes the dehumidification heater when the humidity is equal to or higher than a certain value, and cuts off the energization of the dehumidification heater when the humidity falls below the certain value, to thereby control drying of the sheets.

On the other hand, in recent years, a power saving mode is provided in image forming apparatuses due to a rise in the awareness of the energy saving. In the power saving mode, power supply to parts constituting the image forming apparatus is stopped, thereby reducing the power consumption in a standby state. Depending on image forming apparatuses, parts whose power supply is stopped in the power saving mode are different. In general, when there are a larger number of parts whose power supply is stopped, a higher power-saving effect is achieved. Accordingly, power supply to the control unit of the image forming apparatus may be stopped.

Thus, with a transition to the power saving mode, power supply to the control unit which controls the operation (energization) of the dehumidification heater may be stopped. In such a case, during the power saving mode, control over the dehumidification heater and checking of the humidity are not carried out. On the other hand, in order to adequately dehumidify the sheets, it is necessary to maintain the energization of the dehumidification heater for a specified period of time. For this reason, during the power saving mode, the dehumidification heater may be maintained in the same state (ON state or OFF state).

However, in the case where the power saving mode continues for a long period of time, when the dehumidification heater is maintained in the ON state, dehumidification is continued even though the sheets have dried, resulting in the continuation of wasteful dehumidification. On the other hand, when the dehumidification heater is maintained in the OFF state for a long period of time, the sheets absorb moisture, which may cause a trouble in sheet feeding or conveyance.

Accordingly, it is conceivable to resume power supply temporarily and regularly to drive the control unit even in the power saving mode in order to switch the ON/OFF of the dehumidification heater in the power saving mode. In this case, start-up of the control unit, checking of the humidity, and switching the ON/OFF of the dehumidification heater are carried out.

However, overly frequent resumption of power supply to the control unit leads to a problem that the power-saving effect obtained from the power saving mode is lost. On one hand, when the cycle of temporary power supply to the control unit is too long, the time during which the dehumidification heater wastefully operates becomes long even though the humidity is sufficiently reduced. On the other hand, conversely, the sheets may absorb a large amount of moisture. Accordingly, there is a problem that temporary power supply to the control unit needs to be performed in an appropriate cycle (timing) so as not to impair the power-saving effect.

In this respect, no considerations for switching the ON/OFF of the dehumidification heater in the power saving mode and temporary power supply to the control unit have conventionally been made, which is also the case of the publicly-known sheet feeding apparatus described above. Therefore, the above-mentioned problems regarding whether or not to operate the main control unit and the like in the power saving mode, or to temporarily operate the main control unit cannot be solved.

SUMMARY OF THE DISCLOSURE

The present disclosure has been made in view of the above-mentioned problems in the conventional technology, and has an object to achieve a high power-saving effect by reducing wasteful energization of a dehumidification heater and optimizing a cycle (interval) of temporary power supply to a control unit during a power saving mode.

In order to attain the above-mentioned object, an image forming apparatus according to a first aspect of the present disclosure includes a sheet feeding unit including a dehumidification heater, for housing a stack of sheets and supplying a sheet at a time of printing, a humidity sensing element for sensing humidity, a dehumidification heater switching unit for being set to maintain an ON state in which energization of the dehumidification heater is performed or an OFF state in which the energization of the dehumidification heater is cut off, a control unit for recognizing the humidity based on an output of the humidity sensing element with a start of power supply, bringing the dehumidification heater switching unit into the ON state when the recognized humidity is equal to or greater than a predetermined reference value, and bringing the dehumidification heater switching unit into the OFF state when the recognized humidity falls below the predetermined reference value, and a power supply unit for making a transition from a power saving mode, in which the power supply to the control unit is stopped, to a normal mode, in which the power supply to the control unit is performed, when a recovery condition is met, making a transition from the normal mode to the power saving mode when a transition condition is met, and temporarily resuming the power supply to the control unit in the power saving mode in a longer cycle after the power supply to the control unit is stopped as a difference between the humidity recognized by the control unit and the predetermined reference value is larger.

According to the present disclosure, it is possible to achieve a high power-saving effect by reducing wasteful energization of the dehumidification heater and optimizing the cycle (interval) of the temporary power supply to the control unit during the power saving mode.

Further features and advantages of the present disclosure will become apparent from the description of embodiments given below.

BRIEF DESCRIPTION OF THE DRAWINGS

FIG. 11 is an explanatory diagram illustrating an example of a data table in which a reference value and the like are set for each temperature range.

DETAILED DESCRIPTION OF PREFERRED EMBODIMENT

In the following, an embodiment of the present disclosure is described with reference to FIGS. 1 to 11. In the description of this embodiment, an electrophotographic multifunction peripheral 100 (corresponding to an image forming apparatus) is described by way of example. However, elements described in this embodiment, such as a configuration, an arrangement, and the like, merely serve as examples for description, and hence the scope of the present disclosure is not limited thereto.

(Schematic Configuration of Image Forming Apparatus)

Figure 1:
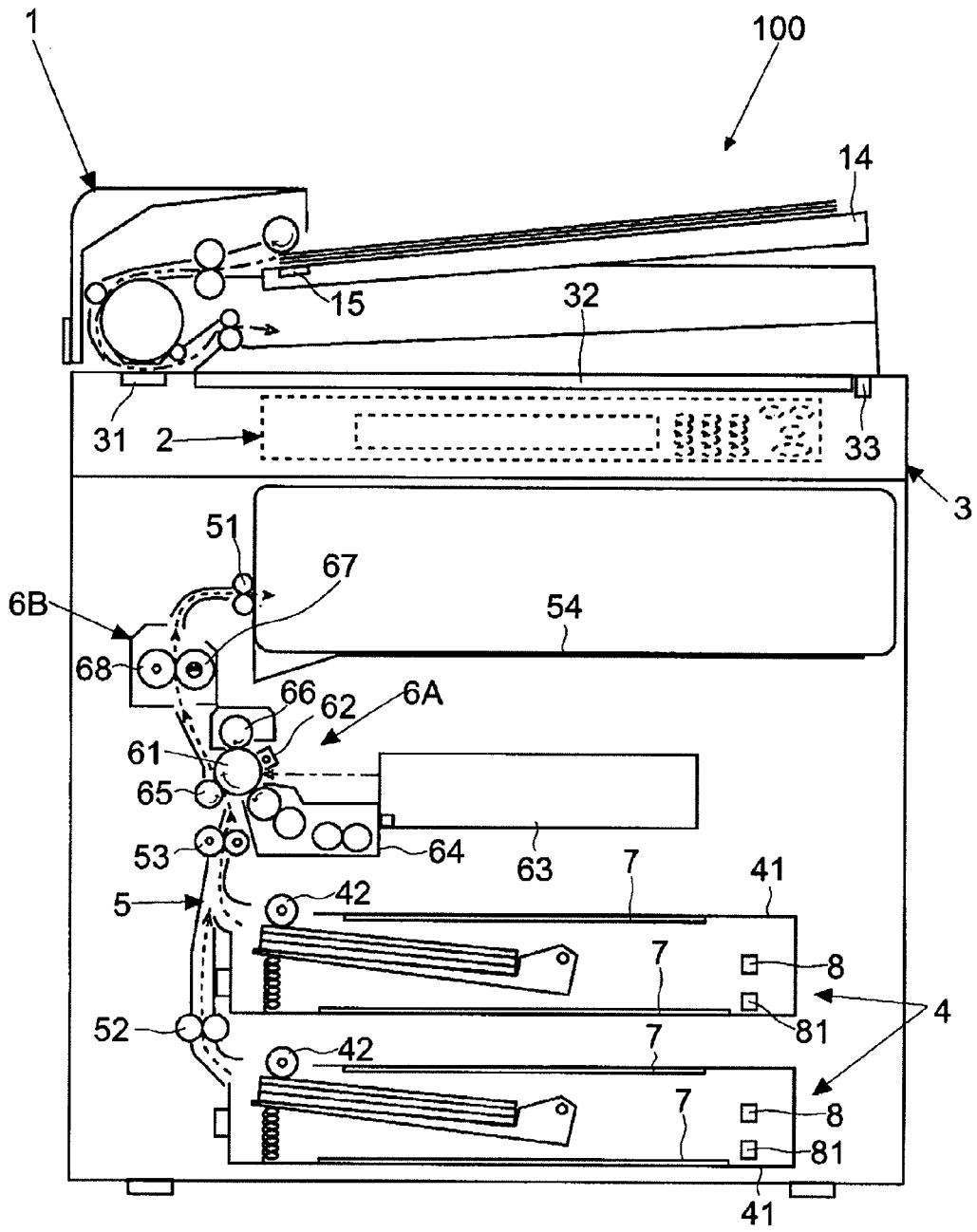
FIG. 1 is a schematic front sectional view of a multifunction peripheral.

First, referring to FIG. 1, an example of the multifunction peripheral according to the embodiment of the present disclosure is described. FIG. 1 is a schematic front sectional view of the multifunction peripheral 100.

The multifunction peripheral 100 of this embodiment includes, in the uppermost portion thereof, a document conveying unit 1. Further, an operation panel 2 (corresponding to an input unit) is provided on the upper side in front of the multifunction peripheral 100 (illustrated by the broken lines of FIG. 1), for displaying settings for print, such as a setting of copy operation, and a state of the multifunction peripheral 100. Further, the multifunction peripheral 100 includes, in the main body thereof, an image reading unit 3, sheet feeding units 4, a conveyance path 5, an image forming unit 6A, a fixing unit 6B, and the like.

The image reading unit 3 reads an original document and generates image data. On an upper surface of the image reading unit 3, two kinds of contact glasses (contact glass for feed reading 31 and contact glass for placement reading 32) are disposed. Further, the image reading unit 3 includes, inside thereof, a moving frame (including an exposure lamp, a mirror, and the like) which moves in a horizontal direction (lateral direction of FIG. 1), and optical system members such as a lens, an image sensor (for example, a charge coupled device (CCD)), and the like (which are not shown). For example, in the case of reading original documents which are successively conveyed by the document conveying unit 1, the moving frame is fixed below the contact glass for feed reading 31 so that reflected light from the original document is guided to the lens and the image sensor. Alternatively, in the case of reading an original document placed on the contact glass for placement reading 32, the moving frame is moved in the horizontal direction so that reflected light from the original document is guided to the lens and the image sensor.

The image reading unit 3 irradiates the original document with light by using those optical system members, and guides the reflected light from the original document to the image sensor. The image sensor subjects an output value on each pixel to analog-to-digital (A/D) conversion, to thereby generate image data. For example, the multifunction peripheral 100 can perform printing operation based on the thus read image data (copy function).

In the multifunction peripheral 100 of this embodiment, the sheet feeding units 4 for receiving and feeding sheets for use in image formation are stacked two in total in a vertical direction. Note that, the sheet feeding units 4 are similar to each other in configuration, and hence members common to the sheet feeding units 4 are denoted by the same reference numerals. A part of the respective sheet feeding units 4 is detachable as a cassette 41 for resupplying sheets and changing the size of sheets.

In each of the sheet feeding units 4, in each cassette 41, a plurality of (for example, about 500 to 1,000) sheets of various types (such as plain sheets, copy sheets, recycled sheets, and the like) in various sizes (such as letter size, A4, A3, B4, and B5) are stacked and received. Each of the sheet feeding units 4 is provided with a sheet feeding roller 42 in contact with the topmost sheet. The sheet feeding roller 42 sends out a sheet to feed the sheet.

Dehumidification heaters 7 are respectively provided on internal top and bottom surfaces of each of the sheet feeding units 4. The dehumidification heaters 7 are, for example, sheets (electrothermal sheets) including electrically-heated wires. The inside of each of the sheet feeding units 4 can be dried by heat generated by the energization of the corresponding dehumidification heaters 7. Herewith, it is possible to prevent the occurrence of creases during conveyance due to moisture absorption of the sheets and the occurrence of multiple sheet feeding (especially, multiple sheet feeding of coated sheets whose surfaces are coated for color printing). Note that, the dehumidification heater 7 may be provided on only any one of the top and bottom surfaces.

In addition, a humidity sensor 8 (corresponding to a humidity sensing element) is provided inside each of the sheet feeding units 4 in order to check the humidity at the time of turning on/off the dehumidification heaters 7 (details are described below). Using the humidity sensor 8 allows to, for example, measure and recognize a relative humidity. Note that, using the humidity sensor 8, an absolute humidity may be measured. In addition, the humidity sensor 8 may be provided near the corresponding sheet feeding unit 4 rather than the inside of the sheet feeding unit 4, and may measure the humidity near the sheet feeding unit 4.

In addition, a temperature sensor 81 (corresponding to a temperature sensing element) may be provided inside each of the sheet feeding units 4. Note that, the temperature sensor 81 may be provided near the image forming unit 6A to be described below rather than the inside of the corresponding sheet feeding unit 4, and it is sufficient if the internal temperature of the multifunction peripheral 100 is detected.

Next, the conveyance path 5 is a path for conveying a sheet inside the apparatus. Further, the conveyance path 5 is provided with a plurality of conveyance roller pairs 51 and 52 which are driven to rotate during sheet conveyance. In addition, also provided are registration roller pair 53, for causing a sheet being conveyed to wait just before the image forming unit 6A and sending the sheet out in accordance with a timing of the formation of a toner image, and the like. In addition, also provided is a delivery tray 54 for receiving a sheet delivered from a delivery opening.

The image forming unit 6A forms an image (toner image) based on image data, the image forming unit 6A transfers the toner image onto the sheet fed by one the sheet feeding units 4. Note that, image data of an original document obtained by the image reading unit 3 and image data transmitted from a computer 200 (see FIG. 2) and the like to be connected to the multifunction peripheral 100 are used. And the image forming unit 6A includes a photosensitive drum 61 which is supported to be rotatably driven in the direction of the arrow illustrated in FIG. 1. In addition, the image forming unit 6A includes a charging device 62, an exposing device 63, a developing device 64, a transfer roller 65, a cleaning device 66, and the like which are disposed around the photosensitive drum 61.

Processes of toner image formation and transfer are described. The photosensitive drum 61 is driven to rotate in a predetermined direction. And the charging device 62 charges the photosensitive drum 61 to a predetermined potential. Based on the image data, the exposing device 63 emits a laser light, and scans and exposes the surface of the photosensitive drum 61 to form an electrostatic latent image in accordance with the image data.

Then, the developing device 64 supplies a toner to the electrostatic latent image formed on the photosensitive drum 61 to develop the electrostatic latent image. The transfer roller 65 is in pressure contact with the photosensitive drum 61 to form a nip. Then, the registration roller pair 53 cause a sheet to enter the nip at an appropriate timing. When the sheet and the toner image enter the nip, a predetermined voltage is applied to the transfer roller 65. Herewith, the toner image on the photosensitive drum 61 is transferred to the sheet. The cleaning device 66 removes the toner and the like remaining on the photosensitive drum 61 after the transfer.

The fixing unit 6B fixes the transferred toner image onto the sheet. The fixing unit 6B according to this embodiment includes a heating roller 67 incorporating a heating element therein and a pressure roller 68. The heating roller 67 and the pressure roller 68 are in pressure-contact with each other, to thereby form a nip. When the sheet passes through the nip, the toner is fused and heated so that the toner image is fixed onto the sheet. The sheet having the toner image fixed thereon is delivered to the delivery tray 54.

(Hardware Configuration of Multifunction Peripheral 100)

Figure 2:
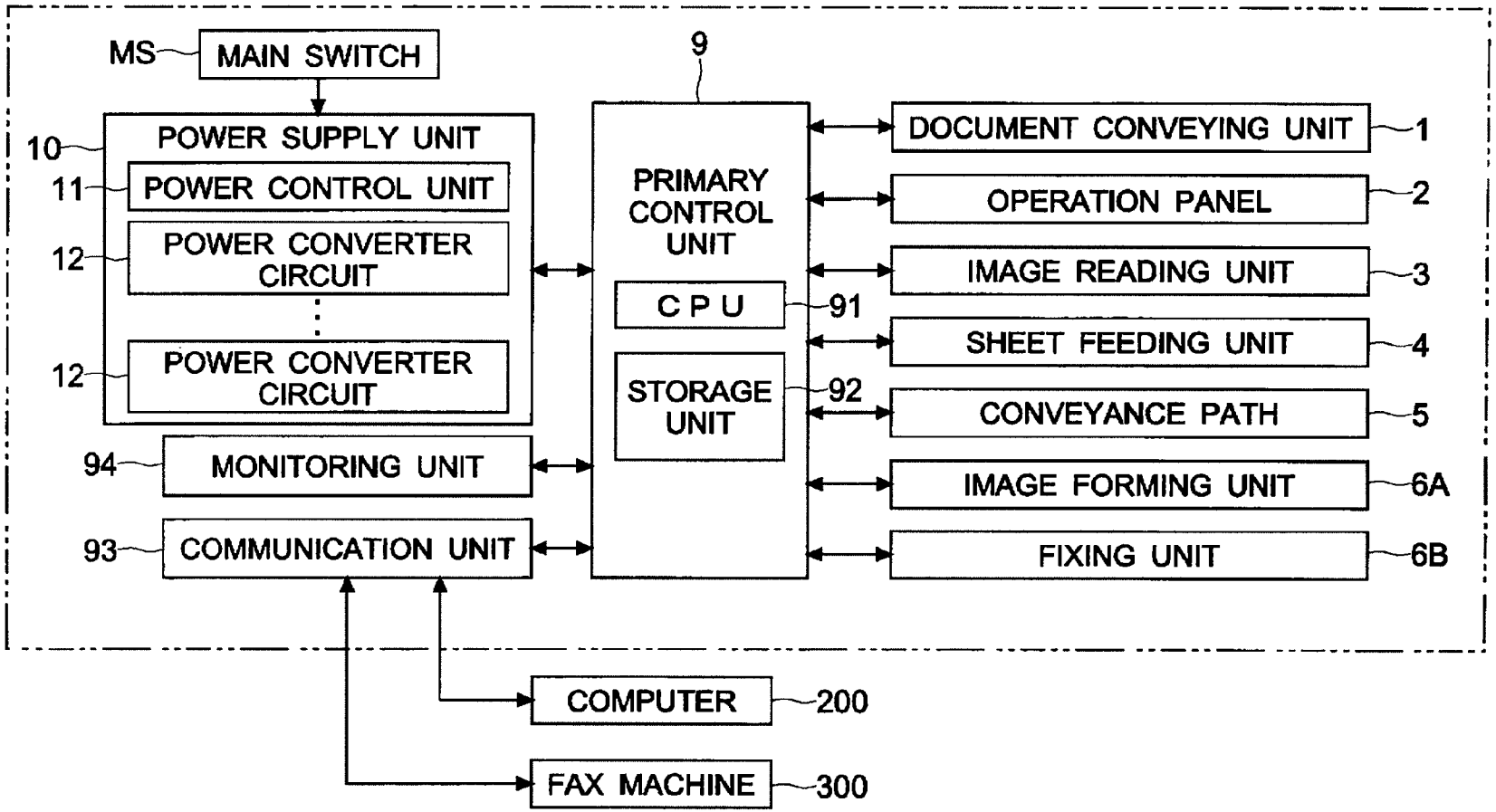
FIG. 2 is a block diagram illustrating an example of a hardware configuration of the multifunction peripheral.

Next, referring to FIG. 2, description is given of an example of a hardware configuration of the multifunction peripheral 100 according to the embodiment of the present disclosure. FIG. 2 is a block diagram illustrating the example of the hardware configuration of the multifunction peripheral 100.

First, a primary control unit 9 (corresponding to a control unit) is provided inside the multifunction peripheral 100 main body, as a part for controlling an operation of the multifunction peripheral 100. The primary control unit 9 is a board including, for example, a CPU 91 as a control element. The primary control unit 9 performs overall control on the multifunction peripheral 100. The primary control unit 9 may be divided depending on its function and provided as a plurality of parts, such as a part for performing overall control, a part for performing communication control, a part for performing image processing, and an engine control unit for controlling image formation and printing through ON/OFF control on a motor or the like for rotating various rotary bodies. In the description to be given herein, a configuration in which the above-mentioned plurality of control units are integrated into one control unit is illustrated.

The primary control unit 9 includes a storage unit 92. The storage unit 92 is capable of storing image data and the like as well as a program and data for controlling the multifunction peripheral 100. For example, the storage unit 92 is a combination of a volatile storage device such as a random access memory (RAM) and a non-volatile storage device such as a read-only memory (ROM), a hard disk drive (HDD), or a flash ROM. The CPU 91 performs arithmetic operations, and transmits and receives control signals, based on programs and data stored in the storage unit 92, to thereby control the multifunction peripheral 100.

The primary control unit 9 is communicatively connected to each of the document conveying unit 1, the image reading unit 3, the sheet feeding unit 4, the conveyance path 5, the image forming unit 6A, and the fixing unit 6B, to thereby perform control on each unit. Further, the primary control unit 9 is communicatively connected to the operation panel 2. With this configuration, contents of settings and input by a user through the operation panel 2 is conveyed to the primary control unit 9. The primary control unit 9 operates respective units included in the multifunction peripheral 100 by giving instructions to the image forming unit 6A and the like so that the respective units operate in accordance with configuration settings.

Further, the primary control unit 9 is connected to a communication unit 93. The communication unit 93 serves as an interface for performing communications with the computer 200 (for example, personal computer) or a communication partner's fax machine 300 via a network, a cable, or a communication network. With this configuration, the multifunction peripheral 100 is capable of performing printing (printer function) based on image data or the like received from the computer 200, storing image data read by the image reading unit 3 in the storage unit 92 and then transmitting the image data to the computer 200 (scanner function), and exchanging image data with the external fax machine 300 (facsimile function).

In addition, a power supply unit 10 is provided inside the multifunction peripheral 100. The power supply unit 10 is connected to, for example, a commercial power supply and generates various voltages. In addition, a main switch MS for activating a main power supply, which switches on/off the connection between the commercial power supply and the power supply unit 10, is also provided (for example, on a lateral side of the multifunction peripheral 100).

The power supply unit 10 includes a plurality of power converter circuits 12 including, for example, a rectifier circuit, a transformer, a converter, a smoothing circuit, and the like. Using the power converter circuits 12, the power supply unit 10 generates a plurality of types of voltages required to operate the multifunction peripheral 100. The power supply unit 10 generates, for example, a DC voltage of 24 V for driving a motor, a DC voltage of 5 V for driving a circuit element in the primary control unit 9 or the like, a DC voltage of 3.3 V, and the like, and gives the generated DC voltages to respective units inside the multifunction peripheral 100.

Note that, the multifunction peripheral 100 of this embodiment has a normal mode and a power saving mode which reduces power consumption compared to the normal mode. These modes are different in voltages to be generated and the amount of current to be supplied. Accordingly, a power control unit 11 is provided for controlling the operation of the power supply unit 10 (respective power converter circuits 12 inside the power supply unit 10) in accordance with each of the modes.

In addition, a monitoring unit 94 for monitoring whether or not to cause recovery from the power saving mode to the normal mode (whether or not a recovery trigger has occurred) is provided inside the multifunction peripheral 100. By providing the monitoring unit 94, power supply to the primary control unit 9 is stopped in the power saving mode. On the other hand, even in the power saving mode, power is supplied to the monitoring unit 94 to be driven. The monitoring unit 94 mainly monitors recovery from the power saving mode to the normal mode and its circuit size can be smaller than that of the primary control unit 9, and therefore power consumption can be reduced compared to driving the primary control unit 9 in the power saving mode.

(Dehumidification at Sheet Feeding Unit 4)

Figure 3:
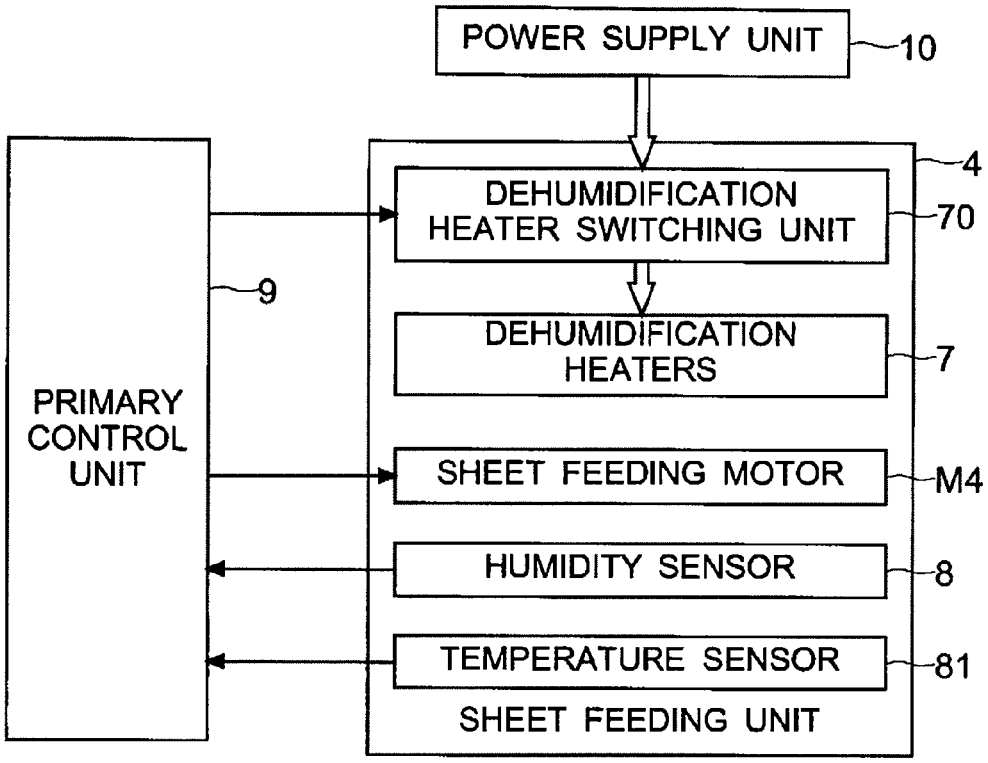
FIG. 3 is a block diagram illustrating an example of a configuration for dehumidification of a sheet feeding unit.

Next, referring to FIG. 3, description is given of an example of a configuration related to dehumidification at the respective sheet feeding units 4 according to this embodiment. FIG. 3 is a block diagram illustrating an example of the configuration for dehumidification of the respective sheet feeding units 4. Note that, because the respective sheet feeding units 4 are identical to one another, only one sheet feeding unit 4 is illustrated in FIG. 3.

First, in the multifunction peripheral 100 of this embodiment, control of the sheet feeding unit 4 is performed by the primary control unit 9. Note that, when a control unit (for example, the engine control unit) other than the primary control unit 9 for performing control related to image formation is provided, the control unit other than the primary control unit 9 may perform the control of the sheet feeding unit 4. In addition, a sheet feeding control unit (for example, a substrate on which a CPU, a microcomputer, and a memory are mounted) for performing an actual operation of the sheet feeding unit 4 may be provided inside the sheet feeding unit 4, and the primary control unit 9 or the engine control unit may give an instruction to the sheet feeding control unit and cause the sheet feeding control unit to control the operation of the sheet feeding unit 4. Thus, there are a plurality of types of possible modes for providing a control unit for controlling the sheet feeding unit 4. In the description given herein, an example in which the primary control unit 9 performs the control of the sheet feeding unit 4 is described. Note that, in the case where the engine control unit or the sheet feeding control unit is provided, the engine control unit or the sheet feeding control unit may perform control for dehumidification described below.

For example, when performing printing, the primary control unit 9 operates a sheet feeding motor M4 to thereby send a print sheet out of the sheet feeding unit 4.

In addition, the sheet feeding unit 4 is provided with the dehumidification heaters 7. The primary control unit 9 controls the energization of the dehumidification heaters 7. Specifically, a dehumidification heater switching unit 70 for switching on/off the energization of the dehumidification heaters 7 is provided in the sheet feeding unit 4. When the primary control unit 9 turns the dehumidification heater switching unit 70 into an ON state, power supplied from the power supply unit 10 is given to the dehumidification heaters 7 (the flow of power is indicated by outline arrows in FIG. 3). On the other hand, when the primary control unit 9 turns the dehumidification heater switching unit 70 into an OFF state, the power supplied from the power supply unit 10 to the dehumidification heaters 7 is stopped.

When receiving switching control instruction from the primary control unit 9, the dehumidification heater switching unit 70 maintains the ON/OFF state with respect to the energization of the dehumidification heaters 7 until receiving the next switching control instruction. Accordingly, when dehumidification is necessary, the dehumidification heater switching unit 70 is brought into the ON state even in the power saving mode and the energization of the dehumidification heaters 7 may be continued.

In addition, the sheet feeding unit 4 is provided with the humidity sensor 8. An output of the humidity sensor 8 is input to the primary control unit 9. For example, in the storage unit 92, a data table which describes humidity relative to output voltage of the humidity sensor 8 is stored. Using the data table, the primary control unit 9 checks and recognizes the humidity inside the sheet feeding unit 4. When the recognized humidity is equal to or greater than a reference value Ht, the primary control unit 9 controls the dehumidification heater switching unit 70 to turn on (energize) the dehumidification heaters 7 (details are described below).

In addition, the sheet feeding unit 4 may also be provided with the temperature sensor 81. An output of the temperature sensor 81 is input to, for example, the primary control unit 9. For example, in the storage unit 92, a data table which describes temperature relative to output voltage of the temperature sensor 81 is stored. Using the data table, the primary control unit 9 checks and recognizes the temperature.

(Normal Mode and Power Saving Mode)

Figure 4:
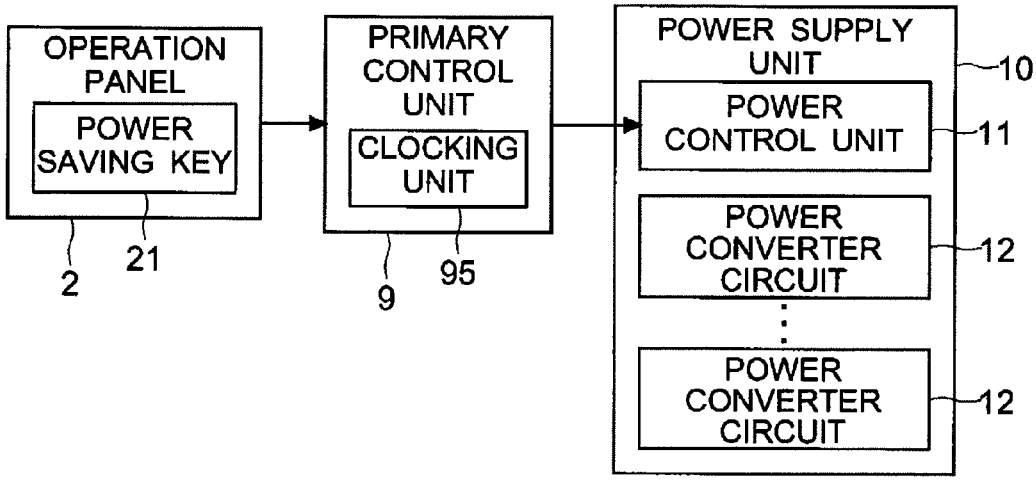
FIG. 4 is an explanatory diagram illustrating a transition from a normal mode to a power saving mode.
Figure 5:
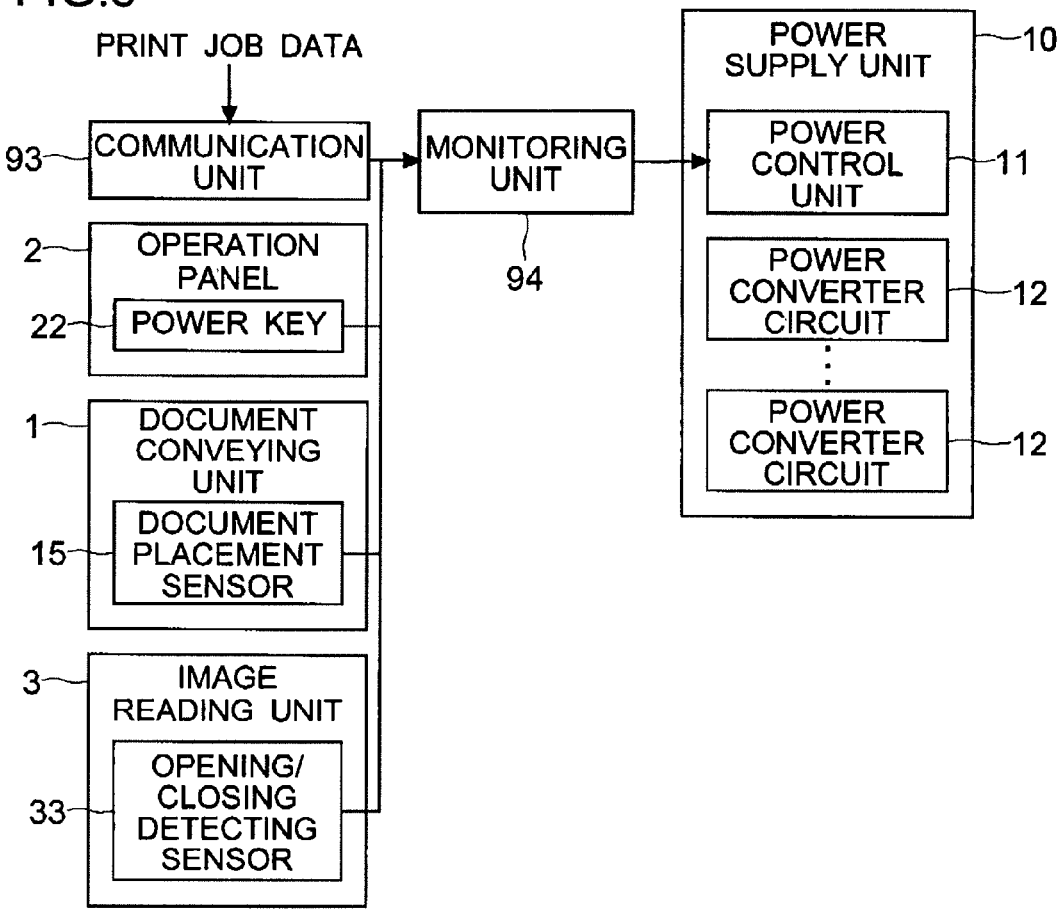
FIG. 5 is an explanatory diagram illustrating recovery from the power saving mode to the normal mode.

Next, referring to FIGS. 4 and 5, description is given of an example regarding the normal mode and the power saving mode of the multifunction peripheral 100 according to this embodiment. FIG. 4 is an explanatory diagram illustrating a transition from the normal mode to the power saving mode. FIG. 5 is an explanatory diagram illustrating recovery from the power saving mode to the normal mode.

First, by power-on of the main switch MS of the multifunction peripheral 100 (power-on of the main power supply), the power supply unit 10 is connected to the commercial power supply. Then, the power supply unit 10 generates a plurality of types of voltages as described above. Subsequently, power is supplied to all parts of the multifunction peripheral 100.

Then, start-up of the primary control unit 9 and warming-up of parts for conducting reading and printing (reading of a main program from the storage unit 92, warming-up of the fixing unit 6B, and the like) are initiated. In the end, by the power-on of the main power supply, a state is obtained in which all functions of the multifunction peripheral 100 are available, and thus the multifunction peripheral 100 is set in the normal mode.

The normal mode of the description given herein refers to a state in which the main power supply has been powered on, warming-up has been completed, and power is supplied (all) the respective parts of the multifunction peripheral 100 so as to render the multifunction peripheral 100 immediately available.

<<Transition from Normal Mode to Power Saving Mode>>

Next described is a transition from the normal mode to the power saving mode with reference to FIG. 4. In the normal mode, the multifunction peripheral 100 is available immediately. However, even in a state in which the multifunction peripheral 100 is not in use (standby state), a certain amount of power is consumed by the primary control unit 9 and the fixing unit 6B. Accordingly, the multifunction peripheral 100 of this embodiment has the power saving mode, which reduces power consumption compared to the normal mode.

When a condition for a transition from the normal mode to the power saving mode is met (satisfied), a transition from the normal mode to the power saving mode takes place. Conditions for the transition can be determined arbitrarily. For example, a press on a power saving key 21 which is provided on the operation panel 2 and used to instruct a transition to the power saving mode may be a condition for a transition to the power saving mode.

In addition, a condition for a transition to the power saving mode may be that, for example, a job execution has been completed, then there is no input to the multifunction peripheral 100 (such as an input to the operation panel 2 and an input of print data to the communication unit 93), and a predetermined time period for a transition to the power saving mode (for example, a few minutes) has elapsed after the multifunction peripheral 100 enters an unused state (standby state). For example, a clocking unit 95 provided in the primary control unit 9 clocks the predetermined time period for a transition to the power saving mode.

When the condition for a transition to the power saving mode is satisfied, the primary control unit 9 instructs a transition to the power saving mode to the power control unit 11 of the power supply unit 10. In response to the instruction, the power control unit 11 performs control of the operation of the power converter circuits 12 and switching of the power supply path in such a manner that power is supplied only to parts which operate also in the power saving mode. In addition, the power control unit 11 causes the power converter circuits 12 to generate only voltages required in the power saving mode.

Parts which operate also in the power saving mode may be determined arbitrarily. However, in the multifunction peripheral 100 of this embodiment, power is supplied in the power saving mode only to predetermined parts, such as a recovery trigger detecting unit for detecting the occurrence of a trigger for recovery from the power saving mode to the normal mode, the monitoring unit 94 for monitoring the occurrence of a recovery trigger, and the dehumidification heaters 7. Herewith, in the power saving mode, power supply to parts constituting the multifunction peripheral 100, such as the primary control unit 9, the image reading unit 3, and the image forming unit 6A, is stopped.

<<Cancellation of Power Saving Mode: From Power Saving Mode to Normal Mode>>

In the power saving mode, power is supplied to limited parts and the power consumption of the multifunction peripheral 100 is reduced. However, in the power saving mode, various functions (copy, scan, print, fax, and the like) of the multifunction peripheral 100 are not available for reasons such as that power supply to the primary control unit 9, the image forming unit 6A, and the like is stopped and voltages for driving various motors are not generated.

Accordingly, in the multifunction peripheral 100 of this embodiment, certain operations and inputs to the multifunction peripheral 100 are determined as recovery conditions, and when a recovery condition is satisfied, the multifunction peripheral 100 recovers from the power saving mode to the normal mode, in which various functions of the multifunction peripheral 100 are available.

Conditions for recovery from the power saving mode to the normal mode can be determined arbitrarily. For example, as illustrated in FIG. 5, a recovery condition may be that the communication unit 93 receives job data for printing or the like from an external computer 200 or the fax machine 300 (the communication unit 93 is the recovery trigger detecting unit). Alternatively, as illustrated in FIG. 5, a press on a key, such as a power key 22 on the operation panel 2, may be a recovery condition (the operation panel 2 is the recovery trigger detecting unit).

In addition, placement of an original document on the document conveying unit 1 may be a recovery condition. Note that, in order to detect placement of an original document on the document conveying unit 1, a document placement sensor 15 may be provided to a document tray 14 (the document placement sensor 15 is the recovery trigger detecting unit). The document placement sensor 15 is, for example, an optical sensor for detecting the presence/absence of an original document.

In addition, lifting up and down of the document conveying unit 1 (opening and closing of the document conveying unit 1) may be a recovery condition. Note that, in order to detect opening and closing of the document conveying unit 1, an opening/closing detecting sensor 33 may be provided on the top surface of the image reading unit 3 (the opening/closing detecting sensor 33 is the recovery trigger detecting unit). The opening/closing detecting sensor 33 is, for example, an optical sensor for detecting the document conveying unit 1 being opened at a certain angle or more.

Operations and inputs to the multifunction peripheral 100, with which the multifunction peripheral 100 is likely to be used, are detected by those recovery trigger detecting units. Note that, other types of sensors or the like may be further provided as the recovery trigger detecting units.

An output of each recovery trigger detecting unit is input to the monitoring unit 94. Based on the outputs of the respective recovery trigger detecting units, the monitoring unit 94 detects that a recovery condition is satisfied. With the detection, the monitoring unit 94 instructs recovery to the normal mode to the power control unit 11 of the power supply unit 10. In response to the instruction, the power control unit 11 performs switching of the power supply path in such a manner that power is supplied to all parts of the multifunction peripheral 100. In addition, the power control unit 11 operates all types of power converter circuits 12 (recovery to the normal mode).

Herewith, power supply to all parts constituting the multifunction peripheral 100, such as the document conveying unit 1, the image reading unit 3, the image forming unit 6A, and the primary control unit 9, is resumed. Thus, the power control unit 11 stops power supply to respective units and devices when a predetermined condition for a transition to the power saving mode is met, and resumes power supply to the respective units and devices when a condition for recovery to the normal mode is met.

(Operation Modes of Dehumidification Heaters 7)

Figures 6, 7, 8:
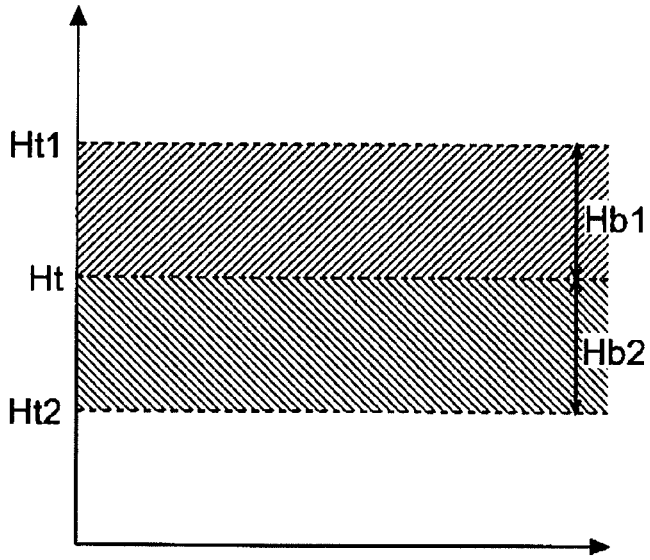
FIG. 6 is an explanatory diagram illustrating an example of a reference value and threshold values for humidity.
FIG. 7 is an explanatory diagram illustrating a basic mode of dehumidification heaters.
FIG. 8 is an explanatory diagram illustrating an energy saving priority mode of the dehumidification heaters.

Referring to FIGS. 6 to 8, the operation of the dehumidification heaters 7 according to this embodiment is described in detail next. FIG. 6 is an explanatory diagram illustrating an example of the reference value Ht and threshold values for humidity. FIG. 7 is an explanatory diagram illustrating a basic mode of the dehumidification heaters 7. FIG. 8 is an explanatory diagram illustrating an energy saving priority mode of the dehumidification heaters 7.

As illustrated in FIG. 6, in the multifunction peripheral 100 of this embodiment, the reference value Ht for humidity is set with regard to turning on/off of the dehumidification heaters 7. The "reference value Ht" is a value which is arbitrarily determined and serves as a guideline for determining that dehumidification is to be performed because multiple sheet feeding and creases are likely to occur when the humidity reaches or exceeds the value, and, in other words, the value is a threshold value for determining whether or not to perform dehumidification. When the detected humidity is equal to or greater than the reference value Ht, the primary control 9 turns on the dehumidification heaters 7. On the other hand, when the detected humidity is less than the reference value Ht, the primary control unit 9 turns off the dehumidification heaters 7. Accordingly, it can be said that the reference value Ht is a threshold value for determining turning on/off of the dehumidification heaters 7. As the detected humidity becomes higher (the difference from the reference value Ht becomes larger), the time required to reduce the humidity of the corresponding sheet feeding unit 4 becomes longer. On the other hand, as the humidity becomes lower (as the difference from the reference value Ht becomes larger), the humidity of the corresponding sheet feeding unit 4 is less likely to exceed the reference value Ht.

In the normal mode, the primary control unit 9 periodically checks an output of the humidity sensor 8 and controls the dehumidification heater switching unit 70 based on the recognized humidity. And in the power saving mode, power supply to the primary control unit 9 is stopped in principle. Because the dehumidification heater switching unit 70 maintains its ON/OFF state, a continuation of the power saving mode for a long period of time may cause a situation in which the dehumidification heaters 7 remain on or a situation in which no dehumidification of the sheets is achieved.

Accordingly, after entrance to the power saving mode, the power supply unit 10 temporarily supplies power to the primary control unit 9 so as to cause the primary control unit 9 to check the humidity of the respective sheet feeding units 4 and turn on/off the corresponding dehumidification heaters 7.

However, when temporary power supply to the primary control unit 9 is performed frequently, the power-saving effect obtained from the power saving mode is impaired. On the other hand, when temporary power supply to the primary control unit 9 is performed too less frequently due to a preference for the power-saving effect, situations may occur in which the dehumidification heaters 7 remain on even when the dehumidification heaters 7 can be turned off, and in which conversely humidity becomes high and the sheets absorb moisture because the dehumidification heaters 7 are not turned on even when the dehumidification heaters 7 should be turned on.

In view of the above, in the multifunction peripheral 100 of this embodiment, the cycle of resuming temporary power supply to the primary control unit 9 in the power saving mode is changed depending on detected and measured humidity. First, referring to FIGS. 6 and 7, a basic mode of temporary power supply to the primary control unit 9 in the power saving mode is described.

<<Basic Mode>>

First, as illustrated in FIG. 6, in the multifunction peripheral 100 of this embodiment, a first threshold value Ht1 and a second threshold value Ht2 are provided for humidity. The first threshold value Ht1 is larger than the reference value Ht. The "first threshold value Ht1" is determined appropriately, but is determined in view of the balance among the dehumidification performance of the dehumidification heaters 7, the length of a second cycle, and the like. For example, the first threshold value Ht1 is a value obtained by adding a roughly estimated value regarding dehumidification achieved by the dehumidification heaters 7 during a first cycle to the reference value Ht. In addition, the second cycle and the first cycle can be determined arbitrarily. For example, the first cycle may be about a fraction (for example, ½) of the second cycle.

In addition, the second threshold value Ht2 is smaller than the reference value Ht. The "second threshold value Ht2" is determined appropriately, and may be a value obtained by subtracting, from the reference value Ht, a value of an average increase in humidity when the dehumidification heaters 7 are stopped during the first cycle, or may be determined in view of the balance with the second cycle and the like.

Further, as illustrated in FIG. 7, in the basic mode, the first cycle is used when the humidity is equal to or greater than the reference value Ht and less than the first threshold value Ht1 (when belonging to a first humidity zone Hb1). In addition, in the basic mode, the first cycle is also used when the humidity is equal to or greater than the second threshold value Ht2 and less than the reference value Ht (when belonging to a second humidity zone Hb2). In other words, the first cycle is used when the humidity is relatively close to the reference value Ht.

On the other hand, as illustrated in FIG. 7, in the basic mode, the second cycle is used when the humidity is equal to or greater than the first threshold value Ht1. In addition, in the basic mode, the second cycle is also used when the humidity is less than the second threshold value Ht2. In other words, the second cycle is used when the humidity does not belong to either the first humidity zone Hb1 or the second humidity zone Hb2 and is relatively far from the reference value Ht.

The first cycle is shorter than the second cycle (the first cycle< the second cycle). Accordingly, when the humidity is close to the reference value Ht, the cycle during which the primary control unit 9 temporarily operates in the power saving mode becomes short. Herewith, when the humidity becomes equal to or less than the reference value Ht, the dehumidification heaters 7 are quickly turned off. This eliminates waste of power consumed by continuously leaving the dehumidification heaters 7 on in spite of a dry condition. In addition, when the humidity exceeds the reference value Ht, the dehumidification heaters 7 are quickly turned on, and therefore it is possible to avoid troubles of the sheets due to moisture absorption.

On the other hand, the second cycle is longer than the first cycle. Accordingly, when the humidity is greatly far from the reference value Ht, the cycle during which the primary control unit 9 temporarily operates in the power saving mode becomes long. Herewith, the primary control unit 9 does not wastefully start up and operate when the humidity does not immediately reach or fall below the reference value Ht even when the dehumidification heaters 7 are brought in operation and when it is recognized that a rise in the humidity is not so sharp as to operate the dehumidification heaters 7. Therefore, wasteful power consumption can be eliminated.

Specific length of the first cycle and the second cycle can be determined arbitrarily. For example, the first cycle is 30 minutes and the second cycle is one hour, or the first cycle is one hour and the second cycle is two hours, and thus it may be defined that the ratio of the first cycle to the second cycle is 1:2.

<<Energy Saving Priority Mode>>

According to the multifunction peripheral 100 of this embodiment, wasteful power consumption can be reduced by controlling a timing of power supply to the primary control unit 9 using the above-mentioned basic mode. The multifunction peripheral 100 of this embodiment has the energy saving priority mode whose power-saving effect is further enhanced than the basic mode. Accordingly, referring to FIG. 8, the energy saving priority mode is described.

As illustrated in FIG. 8, in the energy saving priority mode, the first cycle is used when the humidity is equal to or greater than the reference value Ht and less than the first threshold value Ht1 (when belonging to the first humidity zone Hb1).

On the other hand, as illustrated in FIG. 8, in the energy saving priority mode, the second cycle is used when the humidity is equal to or greater than the first threshold value Ht1. In addition, in the energy saving priority mode, the second cycle is used even when the humidity is less than the reference value Ht. In other words, in the energy saving priority mode, the second cycle (longer cycle) is used when the humidity does not belong to the first humidity zone Hb1.

As in the basic mode, the first cycle is shorter than the second cycle. Accordingly, when the humidity is greater than the reference value Ht but is relatively close to the reference value Ht, the cycle during which the primary control unit 9 temporarily operates in the power saving mode becomes short. Herewith, when the humidity becomes equal to or less than the reference value Ht, the dehumidification heaters 7 are quickly turned off. This eliminates waste of power consumed by continuously leaving the dehumidification heaters 7 on in spite of a dry condition.

On the other hand, the second cycle is longer than the first cycle. Accordingly, when the humidity is greatly far from the reference value Ht, the cycle during which the primary control unit 9 temporarily operates in the power saving mode becomes long. Herewith, the primary control unit 9 does not wastefully operate when the humidity does not immediately reach or fall below the reference value Ht even when the dehumidification heaters 7 are brought in operation. Therefore, wasteful power consumption can be eliminated. Further, the second cycle is also used when the humidity is lower than the reference value Ht. Herewith, it is possible to reduce the frequency of turning on the dehumidification heaters 7 and place priority on power saving.

For temporary power supply to the primary control unit 9 in the power saving mode, whether the cycles are determined in accordance with the basic mode or the energy saving priority mode can be set on the operation panel 2. The result of the setting on the operation panel 2 is, for example, stored in the storage unit 92.

<<Preprocessing for Transition to Power Saving Mode>>

Figure 9:
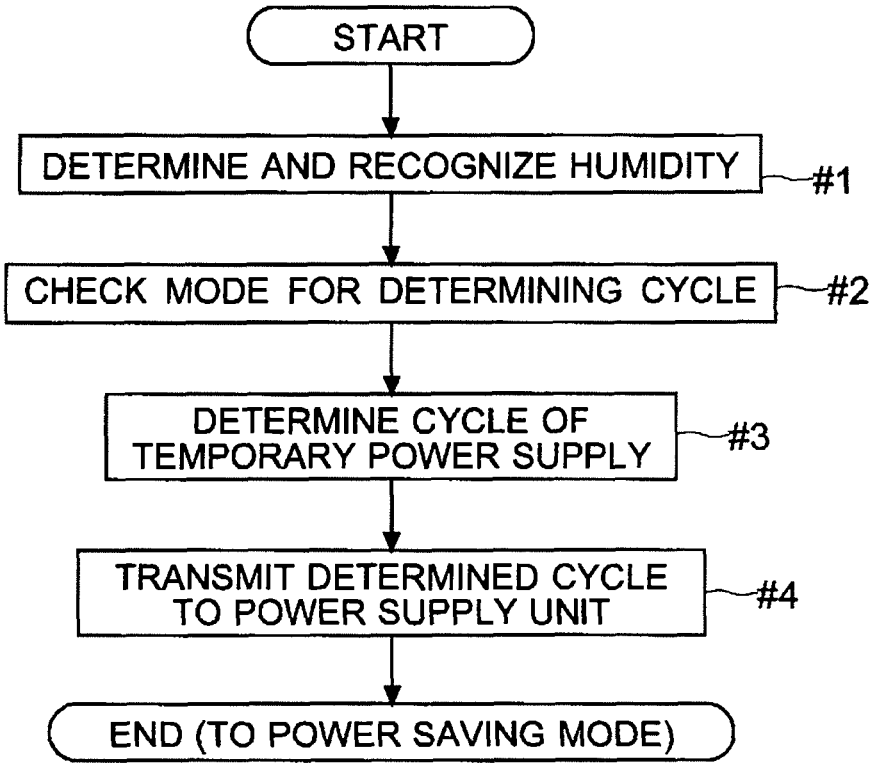
FIG. 9 is a flowchart illustrating an example of a flow of preprocessing for a transition to the power saving mode.

Next, referring to FIG. 9, description is given of an example of a flow of preprocessing for a transition to the power saving mode in the multifunction peripheral 100. FIG. 9 is a flowchart illustrating the example of the flow of the preprocessing for the transition to the power saving mode. In the preprocessing for the transition, processing regarding temporary power supply to the primary control unit 9 in the power saving mode is performed.

First, the start of FIG. 9 is a stage before a transition from the normal mode to the power saving mode is made after a transition condition is satisfied.

First, prior to a transition to the power saving mode, the primary control unit 9 checks and recognizes the humidity based on an output of the humidity sensor 8 (Step #1). The humidity may be measured immediately before a transition to the power saving mode, or may be measured and recognized in the latest humidity check performed in the normal mode. At this point, the energization of the dehumidification heaters 7 has been in any one of the ON and OFF states. Note that, based on the checked humidity and the reference value Ht, the primary control unit 9 may control the dehumidification heater switching unit 70 to turn on/off the dehumidification heaters 7 at the time of Step #1.

Then, the primary control unit 9 checks a mode for determining the cycle in the power saving mode (Step #2). Specifically, the control unit 9 checks a setting for whether the cycle in the power saving mode is determined in accordance with the basic mode or the energy saving priority mode (Step #2). Note that, for example, the default setting may be the basic mode.

Then, based on the set mode, the reference value Ht, the first threshold value Ht1, and the second threshold value Ht2, the primary control unit 9 determines the cycle of temporary power supply in the power saving mode (Step #3). Specifically, the primary control unit 9 determines whether the cycle is the first cycle or the second cycle. Then, the primary control unit 9 transmits the determined cycle to the power supply unit 10 (the power control unit 11) (Step #4). This allows the power supply unit 10 to understand the timing of temporary power supply in the power saving mode. Subsequently, a transition to the power saving mode is made (END). With the transition to the power saving mode, power supply to the primary control unit 9 is stopped in principle.

(Control of Temporary Recovery of Primary Control Unit 9 in Power Saving Mode)

Figure 10:
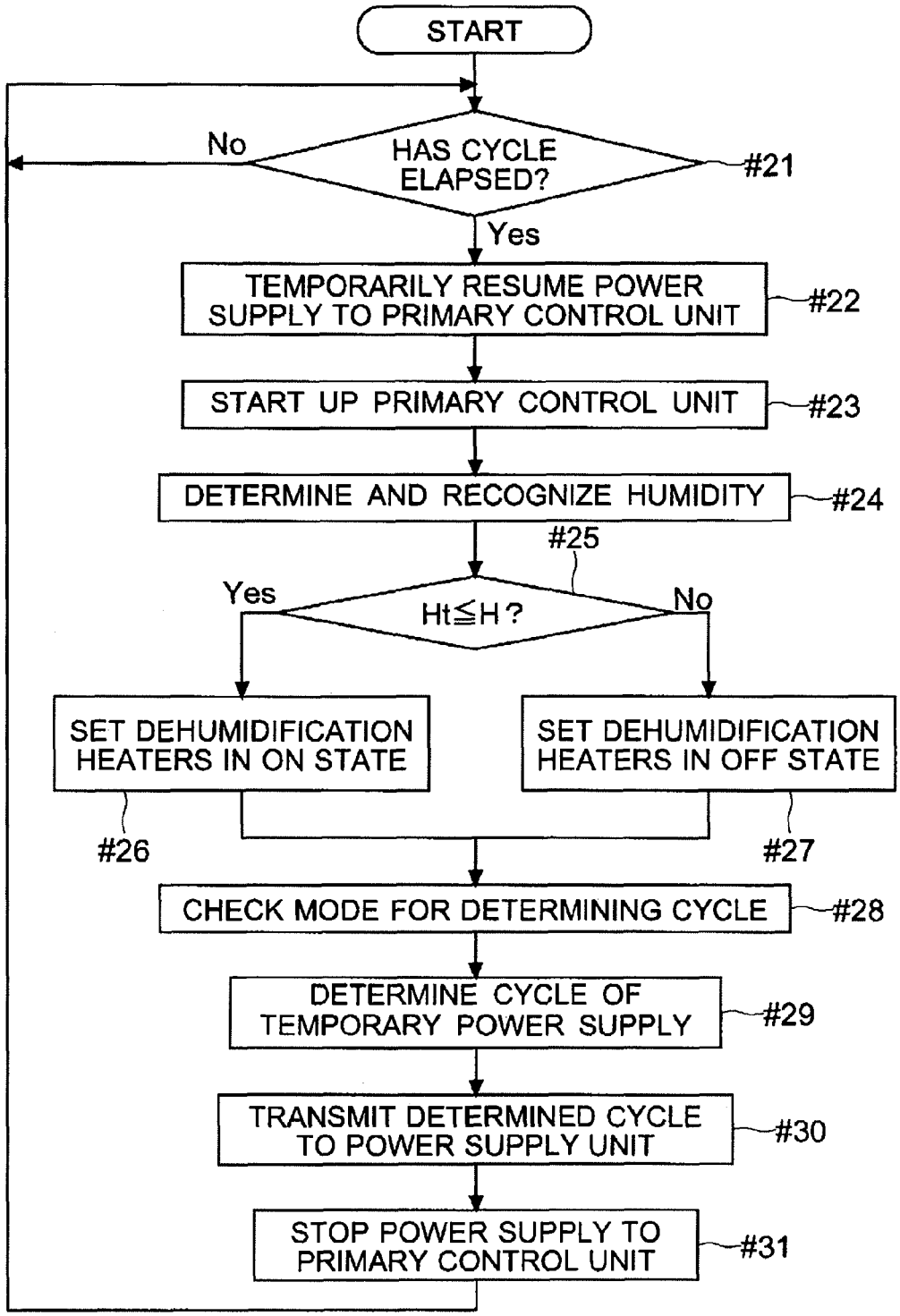
FIG. 10 is a flowchart illustrating an example of a flow of processing after the transition to the power saving mode, which is regarding temporary power supply to a primary control unit in the power saving mode.

Next, referring to FIG. 10, description is given of an example of a flow of temporary power supply to the primary control unit 9 in the power saving mode according to this embodiment. FIG. 10 is a flowchart illustrating an example of a flow of processing regarding the temporary power supply to the primary control unit 9 in the power saving mode. Note that, when recovery to the normal mode is made during execution of the flowchart of FIG. 10, the processing ends in the middle of the flowchart.

First, the power control unit 11 continues to check whether a determined cycle (time) has elapsed since a transition to the power saving mode, or since another stop after temporary power supply to the primary control unit 9 (the loop of Step #21, No in Step #21, and Step #21).

Then, when the determined cycle (time) has elapsed since the transition to the power saving mode or since another stop after temporary power supply to the primary control unit 9 (Yes in Step #21), the power supply unit 10 temporarily resumes power supply to the primary control unit 9 (Step #22). Herewith, the primary control unit 9 starts up (Step #23).

Then, the primary control unit 9 operates the humidity sensor 8, and checks and recognizes the humidity based on an output of the humidity sensor 8 (Step #24). Next, the primary control unit 9 determines whether or not the recognized humidity is equal to or greater than the reference value Ht (reference value Ht≤humidity H) (Step #25).

When the humidity is equal to or greater than the reference value Ht (Yes in Step #25), the primary control unit 9 sets the dehumidification heater switching unit 70 in an ON state to bring the dehumidification heaters 7 into an energized state (Step #26). On the other hand, when the humidity is less than the reference value Ht (No in Step #25), the primary control unit 9 sets the dehumidification heater switching unit 70 in an OFF state to bring the dehumidification heaters 7 into an OFF state (Step #27).

Then, the primary control unit 9 checks a mode for determining the cycle in the power saving mode (Step #28). Subsequently, based on the detected and recognized humidity, the set mode, the reference value Ht, the first threshold value Ht1, and the second threshold value Ht2, the primary control unit 9 determines the cycle of temporary power supply in the power saving mode (Step #29). Specifically, the primary control unit 9 determines whether the cycle is the first cycle or the second cycle.

Then, the primary control unit 9 transmits the determined cycle to the power supply unit 10 (the power control unit 11) (Step #30). Those Steps #28 to #30 are the same as the above-mentioned Steps #2 to #4, respectively.

When receiving data indicating the cycle from the primary control unit 9, the power supply unit 10 stops power supply to the primary control unit 9 (Step #31). Then, the processing returns to Step #21 again, and the power supply unit 10 again waits for a timing of implementing temporary power supply to the primary control unit 9.

(Control of Temporary Recovery of Primary Control Unit 9 in Power Saving Mode Depending on Temperature)

Next, referring to FIG. 11, description is given of control of temporary recovery of the primary control unit 9 in the power saving mode depending on temperature according to this embodiment. FIG. 11 is an explanatory diagram illustrating an example of a data table in which the reference value Ht and the like are determined for each temperature range.

In the description given above, the primary control unit 9 checks and recognizes the humidity based on an output of the humidity sensor 8 in order to determine turning on/off of the dehumidification heaters 7 and the cycle of power supply in the power saving mode. Then, an example is described in which the recognized humidity is compared to the reference value Ht, the first threshold value Ht1, and the second threshold value Ht2. However, for reasons such as that degrees of moisture absorption of sheets are different, it may be preferred to change the reference value Ht, the first threshold value Ht1, the second threshold value Ht2, the first cycle, and the second cycle depending on temperature.

For example, based on an experiment conducted preliminarily, values considered to be preferred for the reference value Ht, the first threshold value Ht1, the second threshold value Ht2, the first cycle, and the second cycle are determined for each temperature range (each temperature width). For example, the storage unit 92 stores a data table which describes these values for each temperature range. FIG. 11 illustrates an example in which values of the reference value Ht, the first threshold value Ht1, the second threshold value Ht2, the first cycle, and the second cycle are determined for each temperature range in increments of 5° C. Note that, values of the reference value Ht, the first threshold value Ht1, the second threshold value Ht2, the first cycle, and the second cycle may be determined for each temperature range in increments of, for example, 1° C., and the increment size may be arbitrary.

Then, the primary control unit 9 recognizes the temperature inside the multifunction peripheral 100 (inside the respective sheet feeding units 4) based on outputs of the temperature sensors 81, and accesses the storage unit 92 and determines a data table to be used (referred). For example, in the flowcharts of FIGS. 9 and 10, recognition of the temperature and determination of data to be referred may be performed at the same time as the recognition of the humidity.

In this way, the disclosure of this embodiment requires a longer time to lower the humidity of the respective sheet feeding units 4 as the detected humidity is higher (as the difference from the reference value Ht is larger). Further, on the other hand, it is understood that the humidity of the respective sheet feeding units 4 is less likely to exceed the reference value Ht as the humidity is lower (as the difference from the reference value Ht is larger). Such requirement of a fixed period of time for a change in the humidity is used.

Then, the image forming apparatus (for example, the multifunction peripheral 100) according to this embodiment includes: the sheet feeding unit 4 including the dehumidification heater 7, for housing a stack of sheets, and supplying a sheet at a time of printing; the humidity sensing element (humidity sensor 8) for sensing humidity; the dehumidification heater switching unit 70 for being set to maintain an ON state in which energization of the dehumidification heater 7 is performed or an OFF state in which the energization of the dehumidification heater 7 is cut off; the control unit (primary control unit 9) for recognizing the humidity based on an output of the humidity sensing element with a start of power supply, bringing the dehumidification heater switching unit 70 into the ON state when the recognized humidity is equal to or greater than the predetermined reference value Ht, and bringing the dehumidification heater switching unit 70 into the OFF state when the recognized humidity falls below the predetermined reference value Ht; and the power supply unit 10 for making a transition from the power saving mode, in which the power supply to the control unit is stopped, to the normal mode, in which the power supply to the control unit is performed, when a recovery condition is met, making a transition from the normal mode to the power saving mode when a transition condition is met, and temporarily resuming the power supply to the control unit in the power saving mode in a longer cycle after the power supply to the control unit is stopped as a difference between the humidity recognized by the control unit and the predetermined reference value Ht is larger.

With this, it is possible to reduce unnecessary temporary power supply to the control unit (primary control unit 9) during the power saving mode by switching the ON/OFF of the dehumidification heaters 7. On the other hand, in the power saving mode, the power supply unit 10 temporarily resumes power supply to the control unit (primary control unit 9) in a shorter cycle as a difference between the latest humidity recognized by the control unit (primary control unit 9) and the reference value Ht is smaller. Herewith, when the humidity falls below the reference value Ht, the dehumidification heaters 7 are turned off as soon as possible. Accordingly, the dehumidification heaters 7 are made to be off as much as possible, thus achieving power saving. On the other hand, even when the humidity exceeds the reference value Ht, the cycle is determined in such a manner as that the dehumidification heaters 7 are turned on as soon as possible. Accordingly, it is also possible to prevent troubles of the sheets due to moisture absorption.

Further, the control unit (primary control unit 9) determines whether or not the recognized humidity is equal to or greater than the first threshold value Ht1 which is larger than the predetermined reference value Ht, and in the power saving mode, the power supply unit 10 resumes the power supply to the control unit in the first cycle when latest humidity recognized by the control unit is equal to or greater than the predetermined reference value Ht and less than the first threshold value Ht1 (when the latest humidity recognized by the control unit belongs to the first humidity zone Hb1), and resumes the power supply to the control unit in the second cycle, which is longer than the first cycle, when the latest humidity recognized by the control unit is equal to or greater than the first threshold value Ht1. With this, when the humidity is so high that the humidity exceeds the first threshold value Ht1, the cycle up to the time of the power supply to the control unit becomes long (second cycle). Accordingly, wasteful start-up of the control unit for humidity check can be avoided until the humidity falls below the reference value Ht, thereby eliminating wasteful power consumption for start-up of the control unit (primary control unit 9). In addition, when the humidity is so close to the reference value Ht that the humidity falls within the first humidity zone Hb1 (between the first threshold value Ht1 and the reference value Ht), the cycle up to the time of power supply to the control unit becomes short (first cycle). Accordingly, when the humidity falls below the reference value Ht, the control unit is started up in a short time and the dehumidification heaters 7 are turned off, thereby eliminating wasteful power consumption of the dehumidification heaters 7.

Further, the control unit (primary control unit 9) determines whether or not the recognized humidity falls below the second threshold value Ht2 which is smaller than the predetermined reference value Ht, and in the power saving mode, the power supply unit 10 resumes the power supply to the control unit in the first cycle when the latest humidity recognized by the control unit is equal to or greater than the second threshold value Ht2 and less than the predetermined reference value Ht (when the latest humidity recognized by the control unit belongs to the second humidity zone Hb2), and resumes the power supply to the control unit in the second cycle, which is longer than the first cycle, when the latest humidity recognized by the control unit is less than the second threshold value Ht2. With this, when the humidity is so low that the humidity falls below the second threshold value Ht2, the cycle up to the time of power supply to the control unit becomes long (second cycle). Accordingly, wasteful start-up of the control unit for humidity check can be avoided until the humidity exceeds the reference value Ht, thereby eliminating wasteful power consumption. In addition, when the humidity is so close to the reference value Ht that the humidity falls within the second humidity zone Hb2 (between the second threshold value Ht2 and the reference value Ht), the cycle up to the time of power supply to the control unit becomes short (first cycle). Accordingly, even when the humidity exceeds the reference value Ht, the control unit is started up in a short time and the dehumidification heaters 7 are turned on, and hence moisture absorption of the sheets is effectively eliminated.

Further, the image forming apparatus (for example, multifunction peripheral 100) according to this embodiment further includes the input unit (operation panel 2) for receiving a select input for making a selection from: the basic mode, in which the power supply to the control unit (primary control unit 9) is resumed in the power saving mode in the first cycle when the latest humidity recognized by the control unit is equal to or greater than the second threshold value Ht2 and less than the first threshold value Ht1 and resumed in the power saving mode in the second cycle when the latest humidity recognized by the control unit is less than the second threshold value Ht2 and when the latest humidity recognized by the control unit is equal to or greater than the first threshold value Ht1; and the energy saving priority mode, in which the power supply to the control unit is resumed in the power saving mode in the first cycle when the latest humidity recognized by the control unit is equal to or greater than the predetermined reference value Ht and less than the first threshold value Ht1 and resumed in the power saving mode in the second cycle when the latest humidity recognized by the control unit falls outside a range equal to or greater than the predetermined reference value Ht and less than the first threshold value Ht1. Then, in the power saving mode, the power supply unit 10 temporarily performs the power supply to the control unit in a mode selected on the input unit. With this, the user is able to have finely-tuned ON/OFF control of the dehumidification heaters 7 during the power saving mode (basic mode), or reduce the number of resumptions of power supply to the control unit as much as possible (energy saving priority mode). Accordingly, it is possible to operate the image forming apparatus in a manner reflecting the intention of the user.

In addition, in some cases, it may be desired to change the reference value Ht and the various threshold values depending on temperature in view of the degree of moisture absorption of the sheets and the dehumidification performance of the dehumidification heaters. In view of the above, according to this embodiment, the image forming apparatus (for example, the multifunction peripheral 100), further includes: the temperature sensing element (temperature sensor 81) for sensing temperature inside and outside the sheet feeding unit 4; and the storage unit 92 for storing different values for the reference value Ht and the threshold values depending on the temperature, in which, in the power saving mode, the power supply unit 10 temporarily performs the power supply to the control unit (primary control unit 9) depending on the temperature based on the values stored in the storage unit 92. With this, it is possible to eliminate moisture absorption of the sheets while achieving a high power-saving effect depending on the temperature environment.

Further, the control unit (primary control unit 9) is configured to: sense the humidity each time the control unit starts up due to the resumption of the temporary power supply in the power saving mode; determine a cycle up to a time point of causing the power supply unit 10 to resume the temporary power supply next time; transmit the determined cycle to the power supply unit 10; and causes the power supply unit 10 to resume the temporary power supply to the control unit (primary control unit 9) in the determined cycle. With this, power supply to the control unit is temporarily resumed in the power saving mode, and the cycle is determined based on the most recently measured humidity. Accordingly, it is possible to always appropriately determine the cycle of temporary recovery and start-up of the control unit so that there is no wasteful power consumption while eliminating moisture absorption of the sheets in the power saving mode.

While the present disclosure has been described above with reference to the embodiments, it is to be understood that the scope of the present disclosure is not limited to the embodiments, and various modifications may be made thereto without departing from the gist of the disclosure.

What is claimed is:

1. An image forming apparatus, comprising:

a sheet feeding unit for housing a stack of sheets and supplying a sheet at a time of printing, the sheet feeding unit including a dehumidification heater;

a humidity sensing element for sensing humidity;

a dehumidification heater switching unit settable to maintain an ON state in which energization of the dehumidification heater is performed, or an OFF state in which the energization of the dehumidification heater is cut off;

a control unit for recognizing the humidity based on an output of the humidity sensing element at a start of supply of power, for bringing the dehumidification heater switching unit into the ON state when the recognized humidity is equal to or greater than a predetermined reference value, and for bringing the dehumidification heater switching unit into the OFF state when the recognized humidity falls below the predetermined reference value; and a power supply unit for making a transition from a power saving mode, in which the supply of power to the control unit is stopped, to a normal mode, in which the supply of power to the control unit is performed when a recovery condition is met, for making a transition from the normal mode to the power saving mode when a transition condition is met, and for temporarily resuming the supply of power to the control unit in the power saving mode after the supply of power to the control unit was stopped, wherein:

the control unit determines whether or not the recognized humidity is equal to or greater than a first threshold value which is larger than the predetermined reference value; and in the power saving mode, the power supply unit resumes the supply of power to the control unit in a first cycle when a latest humidity recognized by the control unit is equal to or greater than the predetermined reference value and less than the first threshold value, and resumes the supply of power to the control unit in a second cycle, which is longer than the first cycle, when the latest humidity recognized by the control unit is equal to or greater than the first threshold value.

2. The image forming apparatus according to claim 1, wherein:

the control unit determines whether or not the recognized humidity falls below a second threshold value which is smaller than the predetermined reference value; and in the power saving mode, the power supply unit resumes the supply of power to the control unit in the first cycle when the latest humidity recognized by the control unit is equal to or greater than the second threshold value and less than the predetermined reference value, and resumes the supply of power to the control unit in the second cycle, which is longer than the first cycle, when the latest humidity recognized by the control unit is less than the second threshold value.

3. The image forming apparatus according to claim 2, further comprising an input unit for receiving a select input for making a selection from:

a basic mode, in which the supply of power to the control unit is resumed in the power saving mode in the first cycle when the latest humidity recognized by the control unit is equal to or greater than the second threshold value and less than the first threshold value and is resumed in the power saving mode in the second cycle when the latest humidity recognized by the control unit is less than the second threshold value and when the latest humidity recognized by the control unit is equal to or greater than the first threshold value; and an energy saving priority mode, in Which the supply of power to the control unit is resumed in the power saving mode in the first cycle when the latest humidity recognized by the control unit is equal to or greater than the predetermined reference value and less than the first threshold value and is resumed in the power saving mode in the second cycle when the latest humidity recognized by the control unit falls outside a range equal to or greater than the predetermined reference value and less than the first threshold value, wherein in the power saving mode, the power supply unit temporarily performs the supply of power to the control unit in a mode selected on the input unit.

4. The image forming apparatus according to claim 2, further comprising:

a temperature sensing element for sensing temperature; and a storage unit for storing different values for the predetermined reference value, the first threshold value, and the second threshold value depending on the temperature, wherein, in the power saving mode, the power supply unit temporarily performs the supply of power to the control unit, depending on the temperature, based on the values stored in the storage unit.

5. An image forming apparatus, comprising:

a sheet feeding unit for housing a stack of sheets and supplying a sheet at a time of printing, the sheet feeding unit including a dehumidification heater;

a humidity sensing element for sensing humidity;

a dehumidification heater switching unit settable to maintain an ON state in which energization of the dehumidification heater is performed, or an OFF state in which the energization of the dehumidification heater is cut off;

a control unit for recognizing the humidity based on an output of the humidity sensing element at a start of supply of power, for bringing the dehumidification heater switching unit into the ON state when the recognized humidity is equal to or greater than a predetermined reference value, and for bringing the dehumidification heater switching unit into the OFF state when the recognized humidity falls below the predetermined reference value; and a power supply unit for making a transition from a power saving mode, in which the supply of power to the control unit is stopped, to a normal mode, in which the supply of power to the control unit is performed when a recovery condition is met, for making a transition from the normal mode to the power saving mode when a transition condition is met, and for temporarily resuming the supply of power to the control unit in the power saving mode in one of a first cycle and a second cycle after the supply of power to the control unit was stopped, based on a difference between the humidity recognized by the control unit and the predetermined reference value, the second cycle being longer than the first cycle, wherein the control unit is configured to:

sense the humidity each time the control unit starts up due to the resumption of the temporary supply of power in the power saving mode;

determine a cycle up to a time point of causing the power supply unit to resume the temporary supply of power next time;

transmit the determined cycle to the power supply unit; and cause the power supply unit to resume the temporary supply of power to the control unit in the determined cycle.

6. A control method for an image forming apparatus, comprising:

setting a dehumidification heater switching unit for maintaining an ON state in which energization of a dehumidification heater of a sheet feeding unit is performed, or an OFF state in which the energization of the dehumidification heater is cut off;

recognizing, by a control unit, based on an output of a humidity sensing element for sensing humidity, the humidity in the image forming apparatus with a start supply of power;

bringing, by the control unit, the dehumidification heater switching unit into the ON state when the recognized humidity is equal to or greater than a predetermined reference value, and bringing the dehumidification heater switching unit into the OFF state when the recognized humidity falls below the predetermined reference value;

making a transition from a power saving mode, in which the supply of power to the control unit is stopped, to a normal mode, in which the supply of power to the control unit is performed, when a recovery condition is met;

making a transition from the normal mode to the power saving mode when a transition condition is met;

temporarily resuming the supply of power to the control unit in the power saving mode after the supply of power to the control unit was stopped, determining, by the control unit, whether or not the recognized humidity is equal to or greater than a first threshold which is larger than the predetermined reference value; and in the power saving mode, resuming the supply of power to the control unit in a first cycle when a latest humidity recognized by the control unit is equal to or greater than the predetermined reference value and less than the first threshold, and resuming the supply of power to the control unit in a second cycle, which is longer than the first cycle, when the latest humidity recognized by the control unit is equal to or greater than the first threshold.

7. The control method for the image forming apparatus according to claim 6, further comprising:

determining, by the control unit, whether or not the recognized humidity falls below a second threshold which is smaller than the predetermined reference value; and in the power saving mode, resuming the supply of power to the control unit in the first cycle when the latest humidity recognized by the control unit is equal to or greater than the second threshold and less than the predetermined reference value, and resuming the supply of power to the control unit in the second cycle, when the latest humidity recognized by the control unit is less than the second threshold.

8. The control method for the image forming apparatus according to claim 7, further comprising:

receiving a select input for making a selection from:

a basic mode, in which the supply of power to the control unit is resumed in the power saving mode in the first cycle when the latest humidity recognized by the control unit is equal to or greater than the second threshold and less than the first threshold and is resumed in the power saving mode in the second cycle when the latest humidity recognized by the control unit is less than the second threshold and when the latest humidity recognized by the control unit is equal to or greater than the first threshold; and an energy saving priority mode, in which the supply of power to the control unit is resumed in the power saving mode in the first cycle when the latest humidity recognized by the control unit is equal to or greater than the predetermined reference value and less than the first threshold, and is resumed in the power saving mode in the second cycle when the latest humidity recognized by the control unit falls outside a range equal to or greater than the predetermined reference value and less than the first threshold; and wherein, in the power saving mode, temporarily performing the supply of power to the control unit in a selected mode.

9. The control method for the image forming apparatus according to claim 7, further comprising:

sensing temperature in the image forming apparatus;

storing different values for the predetermined reference value, the first threshold value, and the second threshold value depending on the temperature; and in the power saving mode, temporarily performing the supply of power to the control unit, depending on the temperature, based on the stored values.

10. A control method for an image forming apparatus, comprising:

setting a dehumidification heater switching unit for maintaining an ON state in which energization of a dehumidification heater of a sheet feeding unit is performed, or an OFF state in which the energization of the dehumidification heater is cut off;

recognizing, by a control unit, based on an output of a humidity sensing element for sensing humidity, the humidity in the image forming apparatus at a start of supply of power;

bringing, by the control unit, the dehumidification heater switching unit into the ON state when the recognized humidity is equal to or greater than a predetermined reference value, and bringing the dehumidification heater switching unit into the OFF state when the recognized humidity falls below the predetermined reference value;

making a transition from a power saving mode, in which the supply of power to the control unit is stopped, to a normal mode, in which the supply of power to the control unit is performed, when a recovery condition is met;

making a transition from the normal mode to the power saving mode when a transition condition is met;

temporarily resuming the supply of power to the control unit in the power saving mode in one of a first cycle and a second cycle after the supply of power to the control unit was stopped, based on a difference between the humidity recognized by the control unit and the predetermined reference value, the second cycle being longer than the first cycle, sensing, by the control unit, the humidity each time the control unit starts up due to the resumption of the temporary supply of power in the power saving mode;

determining, by the control unit, a cycle up to a time point of resuming the temporary supply of power a next time; and resuming, by the control unit, the temporary supply of power to the control unit in the determined cycle.

* * * * *